United States Patent [19]

Küpper et al.

[11] Patent Number: 4,498,644

[45] Date of Patent: Feb. 12, 1985

[54] CREEL

[75] Inventors: Wilhelm Küpper, Wegberg; Gerhard Koslowski, Monchen-Gladbach, both of Fed. Rep. of Germany

[73] Assignee: W. Schlafhorst & Co., Monchen-Gladbach, Fed. Rep. of Germany

[21] Appl. No.: 442,899

[22] Filed: Nov. 19, 1982

[30] Foreign Application Priority Data

Nov. 21, 1981 [DE] Fed. Rep. of Germany ..... 3146170

[51] Int. Cl.[3] ..... D02H 1/00; B65H 49/02

[52] U.S. Cl. ..... 242/131.1

[58] Field of Search ..... 242/131, 131.1, 130

[56] References Cited

U.S. PATENT DOCUMENTS 2,259,079 10/1941 Reiners et al. ..... 242/131.1
2,885,158 5/1959 Koppelman ..... 242/131
3,388,806 6/1968 Cunningham, Jr. et al. ..... 242/131
3,508,722 4/1970 Kohl ..... 242/131.1

*Primary Examiner*—John Petrakes
*Attorney, Agent, or Firm*—Herbert L. Lerner; Laurence A. Greenberg

[57] ABSTRACT

Creel, including a stationary supporting frame, at least one yarn tension holding element and at least one thread guiding element supported by the stationary supporting frame, bobbin holding assemblies disposed in vicinity of the stationary supporting frame, a plurality of bobbin holding elements carried on each of the bobbin holding assemblies, drive rollers connected to the bobbin holder assemblies for supporting the assemblies on a floor, a separate hood-shaped sliding frame connected to each of the assemblies, and a separate upper cover plate disposed on each of the sliding frames covering the drive rollers and part of the floor for preventing accidents and dust accumulation.

5 Claims, 4 Drawing Figures

CREEL

The invention relates to a creel, especially a magazine creel, including bobbin loading elements, yarn tensioning holding elements, thread guiding elements, movable operating units, if necessary, and a stationary supporting frame carrying an element and/or units, the creel having a number of bobbin holding elements carried on bobbin holding assemblies.

During the production of a chain or warp, for example, the individual threads are unwound from the bobbins of a creel, such as a magazine creel, to a thread bundle, are combined and are wound-up. For example, a carriage creel will be used when a batch is expected to be changed. The bobbin holder assemblies are installed on sliding frames. For each batch change and after each idling of the bobbin, the sliding frames must be moved out from the creel. The risk of accident because of the bulky sliding frames is therefore increased. During the creel operation, the floor under the sliding frames gets dusty and dirty and the rails which are provided become filled with flyers and dust.

It is accordingly an object of the invention to provide a creel which overcomes the hereinafore-mentioned disadvantages of the heretofore-known devices of this general type, and which, if possible, is accident-proof and creates no additional inadmissible danger because of the sliding frames, because of the floor under the sliding frames and, if need be, because of the existing rails becoming dusty and dirty.

With the foregoing and other objects in view there is provided, in accordance with the invention, a creel, especially a magazine creel, comprising a stationary supporting frame, at least one yarn tensioning holding element or units and at least one thread guiding element or units supported by the stationary supporting frame, bobbin holding assemblies disposed in vicinity of the stationary supporting frame, a plurality of bobbin holding elements carried on each of the bobbin holding assemblies, drive rollers connected to the bobbin holder assemblies for supporting the assemblies on a floor or bottom, a separate hood-shaped sliding frame connected to each of the assemblies, and a separate cover plate disposed on each of the sliding frames covering the drive rollers and part of the floor or bottom for preventing accidents and dust accumulation.

In accordance with another feature of the invention, there are provided rails disposed on the floor guiding the drive rollers, the rails being covered by the upper cover plates.

In accordance with a further feature of the invention, there are provided movable operation units disposed on the stationary supporting frame for removing dust from the creel.

In accordance with an added feature of the invention, the hood-shaped sliding frame for each of the bobbin holder assemblies are joined together to form a common accident preventive covering.

In accordance with a concomitant feature of the invention, there are provided stationary guiding rollers and transport rollers disposed on the stationary supporting frames, the sliding frames having side walls forming level rolling surfaces for at least one of the guiding and transport rollers.

The advantages obtained with the invention especially concern the avoidance of soiling and the floor and the rails becoming dusty, as well as the avoidance of the creation of a dust cloud caused by the in and out movement of the bobbin holder assemblies. Furthermore, the invention serves to promote accident prevention by working in the creel and permits the safe automatic in and out movement of the bobbin holder assemblies.

Other features which are considered as characteristic for the invention are set forth in the appended claims.

Although the invention is illustrated and described herein as embodied in a creel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
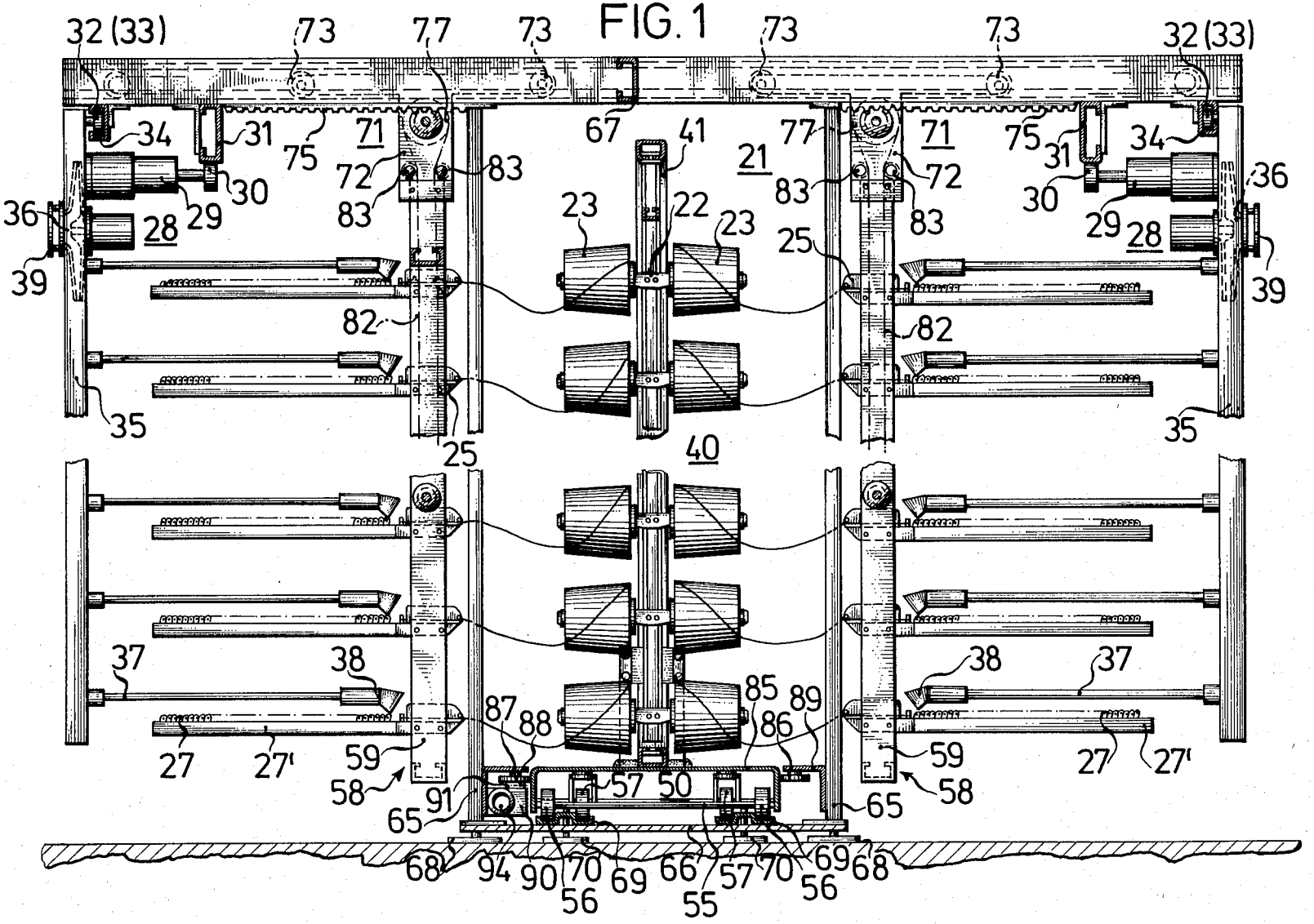
FIG. 1 is a fragmentary, diagrammatic, front elevational view of the creel of the invention.

The illustrated embodiment deals with a carriage creel with external doffing. The creel is generally indicated with reference numeral 21, and has a multitude of similar bobbin holder elements 22. The bobbin holders are formed of U-shaped cold-bent profile bars or bar sections made of sheet steel. Each bobbin holder element is constructed with two arms and carries a bobbin 23 on each arm. In this case the bobbins are formed as conical cross wound spools.

Figure 2:
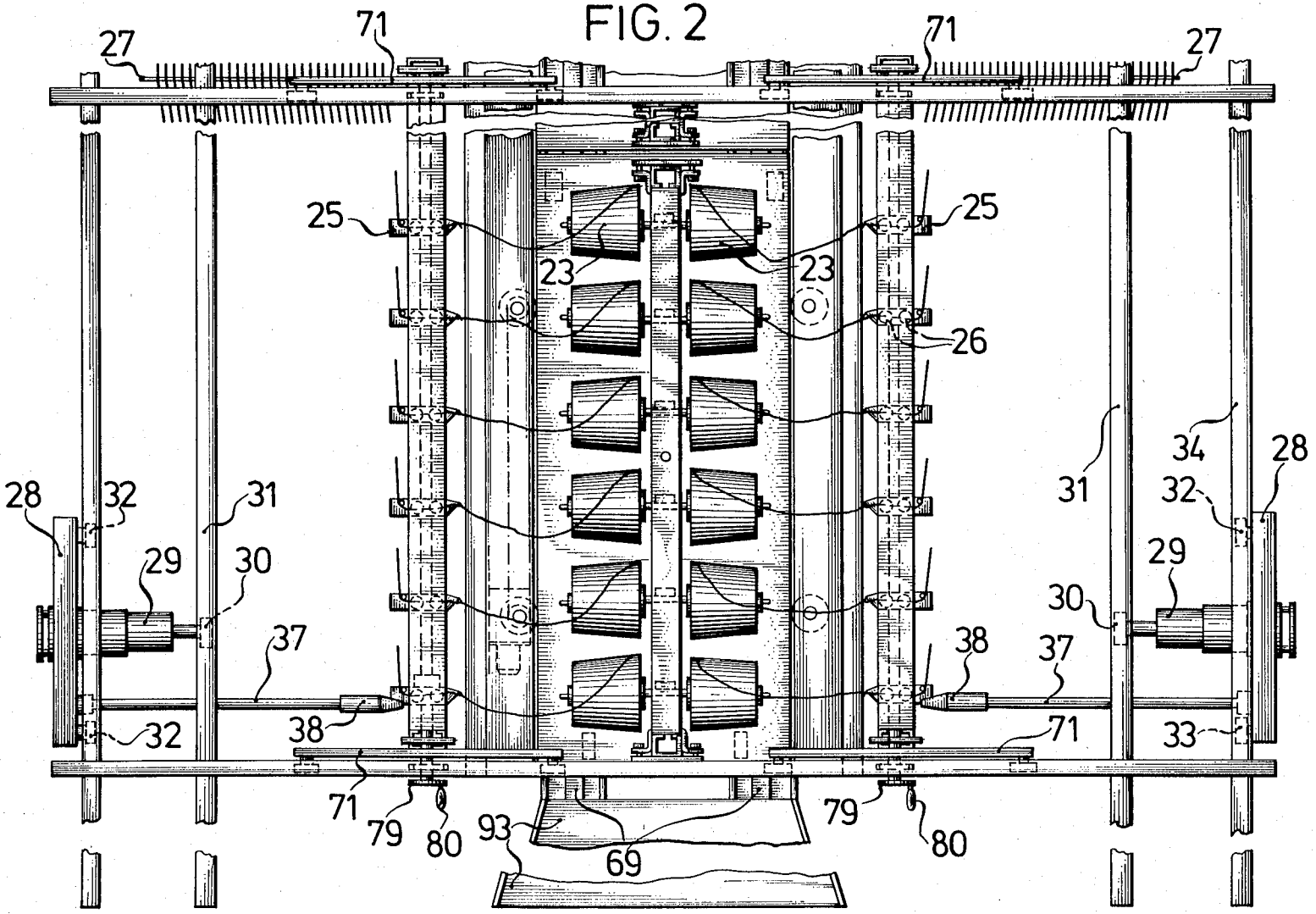
FIG. 2 is a fragmentary plan view of FIG. 1.

In addition, the creel 21 has a multitude of yarn tensioner holding elements 25 made of plastic material. FIG. 2 shows that each yarn tensioner holding element 25 carries a yarn tensioner 26.

FIG. 1 shows that the creel 21 also has thread guiding elements 27 of the same kind, which in this case are combined to form eyelet ledges 27'. In addition, two operation units 28 of the same kind are provided in a mirror image arrangement, in the form of two blast carriages. As FIG. 2 specifically shows, each blast carriage has a travelling gear motor 29, which drives a friction pulley 30. In addition, each operation unit 28 has two drive rollers 32, 33, which are movable on a horizontal beam 34. Two beams 31 and 34 are formed as C-shaped lightweight construction sections, and as cold formed bars made of sheet steel. The supporting frame of the operation unit 28 is constructed as a box-shaped hollow body 35. A ventilator 36 is inserted above in the hollow body 35. The hollow body 35 is connected to a number of similar blast tubes 37, each of which end in a respective blast nozzle 38. The blast nozzles 38 reach a location close to the yarn tensioner holding elements 25. During the operation, the two operation units 28 move forward and backward at the creel, whereby the ventilators 36 suck in air at their suction side 39 and blow it into the hollow body 35, from which the air then comes through the blast tubes 37 to the blast nozzles 38 and during the passage thereof, flows against the yarn tensioners 26, which are situated at the yarn tensioner holding elements 25. The yarn tensioners are constantly kept free from pollution and dust in this way.

Figure 3:
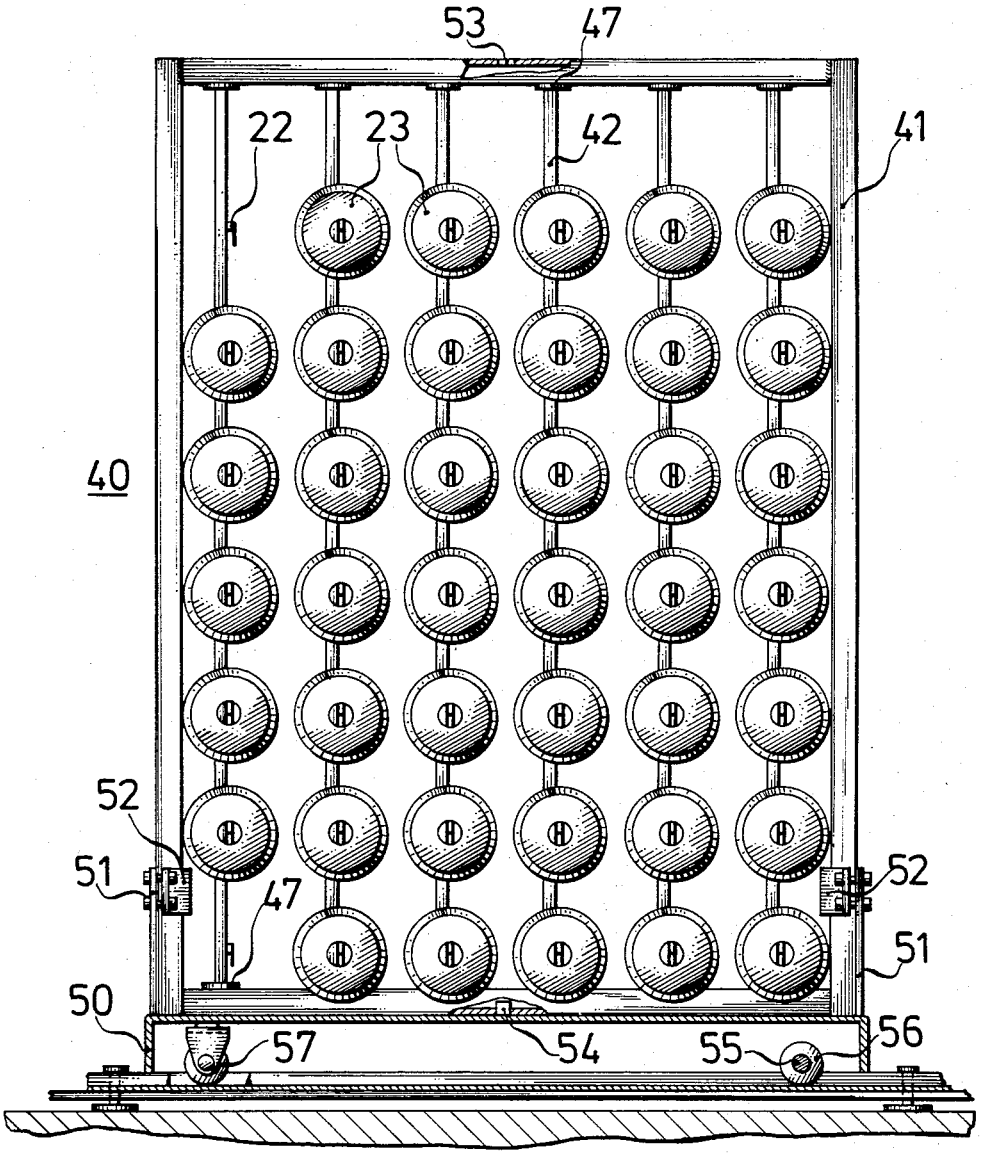
FIG. 3 is an elevational view of an individual bobbin holder assembly, being partly broken away.

The creel 21 has a number of similar bobbin holder assemblies 40. Such a bobbin holder assembly is specifically shown in FIG. 3. The bobbin holder assembly 40 is formed of a frame 41 of cold formed bars made of sheet steel, which are C-shaped in cross section. The open side of each of the bars is situated on a respective inner side of the bobbin supporting frame 41. The frame 41 has six vertical erect bobbin carriers 42 of the same type. At each bobbin carrier, seven bobbin holding elements 22 are fastened. The bobbin holding elements are spaced at equal intervals from each other. The bobbin carriers 42 are fastened to the bobbin supporting frame 41.

Each bobbin holder assembly 40 is connected to a hood-shaped sliding frame 50, which has an upper cover plate 50' and covers drive rollers 56, 57, the floor and rails 69, to make them accident-proof and to prevent dust build up. To this end, the sliding frame 50 carries, on both sides thereof, a vertical erect cover plate 51, respectively, at which a clamp 52 is fastened, which surrounds the side beam of the frame 41.

However, if desired, the bobbin holder assembly 40 can also be connected with a swivel bearing for the frame, which is not represented in this embodiment example, and for this purpose, a bearing 53 above and a bearing 54 below, in the form of respective drilled holes, are provided.

On one side of each sliding frame 50, a shaft 55 runs in bearings with two drive rollers fitted thereon. On the other side, two drive rollers 57 which are in the form of swivel rollers, are provided.

On both sides of the sequence of bobbin holder assemblies 40, the creel 21 has several similar sequences of yarn tensioner assemblies 58, respectively. The individual yarn tensioner assembly 58 has a torsion or warping tape yarn tensioner frame 59 with yarn tensioner beams 60, at which the yarn tensioner holding elements 25 are fastened.

The stationary supporting frame of the creel 21 is formed of the same kind of vertical beams 65, which are connected together and are detachable at lower traverses 66 and at upper traverses 67. The lower traverses 66 are made of sheet steel and carry vertically adjustable feet 68. The upper traverses 67 are made of cold formed bars or sections of sheet steel, which are C-shaped in cross section. The upper traverses carry the afore-mentioned horizontal beams 31 and 34 on their ends, wherein the stationary supporting frame is mechanically stabilized in the upper area. In the lower area, rails 69 rest on the lower traverses 66 and are made of angled sheet steel. A the same time, the rails 69 serve as stabilization elements for the creel 2l. At the connecting location between the rails 69 and the traverses 66, vertically adjustable feet 70 are likewise provided. The center distance between the vertical beams, in the longitudinal direction of the creel, is as large as the length of a yarn tensioner assembly. The horizontal length extended along the creel beams 31 and 34 is a multiple of the whole length of a yarn tensioner assembly, including an addition to the length at the rear of the creel for placing the operation unit 28 in an alternate position or a resting position.

The yarn tensioner assemblies 58 are suspended from travelling gears 71, which rest on the traverses 67. A travelling gear 71 is provided at the respective front ends of the yarn tensioner frame 59. If several yarn tensioner frames are connected together, then this travelling gear 71 also carries the neighboring yarn tensioner frame at the same time. At the rear of the last yarn tensioner frame, a travelling gear is likewise provided. In this way, each yarn tensioner frame 59 at the front and at the rear is either directly or indirectly fastened at a travelling gear 71.

Each travelling gear 71 is formed of a T-shaped sliding frame 72, at which two drive rollers 73 run in bearings. The drive rollers are guided inside the traverses 67, as shown in FIG. 1. For the purpose of the common traverse of all yarn tensioner assemblies 58 of a creel side, a gear 74 runs in bearings at each travelling gear 71, and meshes with a spur rack 75, which is connected to the traverse 67. A chain wheel 77 is fitted on a shaft 76 of the gear. FIG. 2 shows that the chain wheels 77 act together with a shaft 78, which can be turned through a handle 80 fastened to a hand wheel 79. Chain wheels 81 are likewise fitted on the shaft 78 and are connected through chains 82 with the chain wheels 77. Therefore, the chains 82 can be disposed inside the vertical parts of the yarn tensioner frame 59 where they are well protected. Furthermore, above each sliding frame 72 guide wheels 83 are provided. In so far as several yarn tensioner assemblies 58 are provided on each creel side in one creel, the shaft 78 is extended through the coupling sleeves according to this embodiment example.

The above-mentioned yarn guidance elements 27 and eyelet ledges 27' are respectively provided only once on each creel side. They are found at the front vertical part of the first yarn tensioner frame 59. There they are connected through screws with the yarn tensioner frame.

Figure 4:
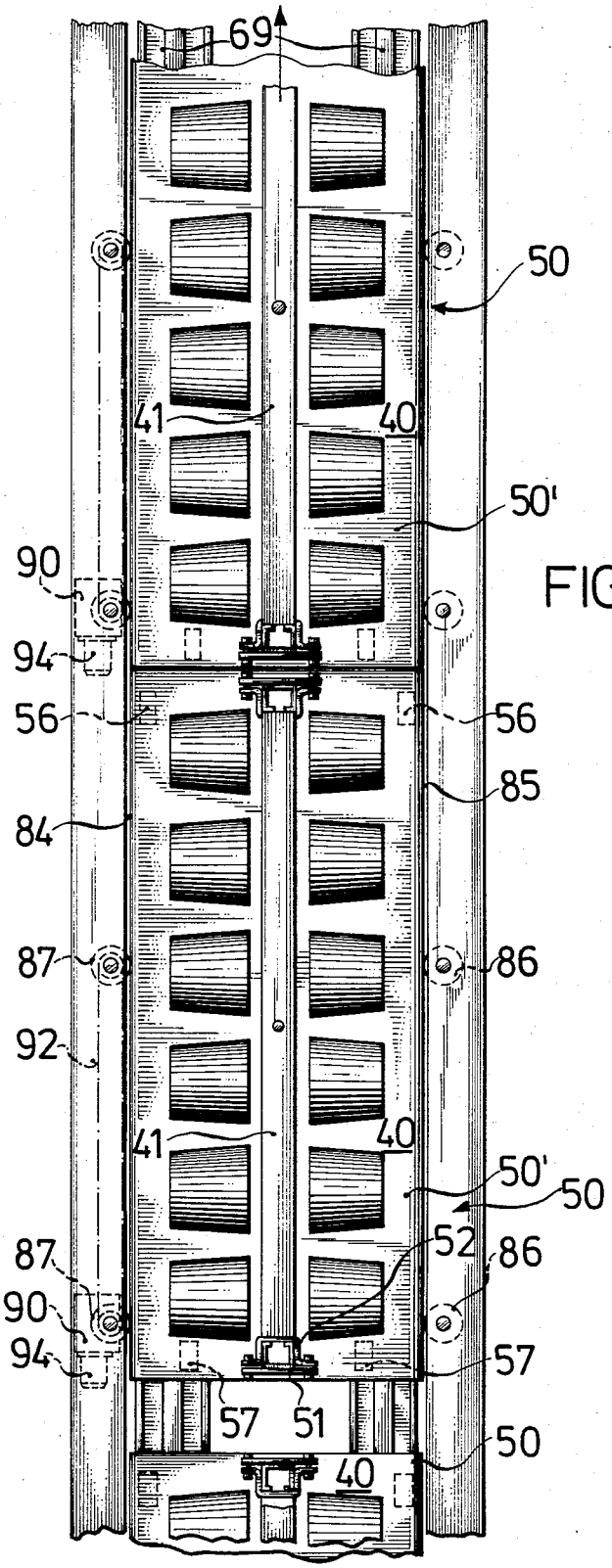
FIG. 4 is a fragmentary plan view representing the formation of the bobbin holder assemblies, which are standing on the sliding frame.

According to FIGS. 1, 2 and 4, the hood-shaped sliding frame 50 has two side walls 84, 85, which are attached to guiding rollers 86 and transport rollers 87. The guiding rollers and transport rollers run in bearings on the side of the stationary supporting frame, with the help of angled parts 88, 89 of sheet steel, that are fastened to the horizontal beam 65.

FIG. 1 particularly shows that the stationary supporting frame forms a path for the in and out movement of the sliding frame 50 and therefore also for the in and out movement of the bobbin holder assemblies 40. The guiding rollers 86 and the transport rollers 87 are disposed in such a way that they are separated on both sides of the path, with the guiding rollers on one side and the transport rollers on the other side. FIG. 4 shows that the guiding rollers 86 and transport rollers 87 are equally divided and amount to approximately double the existing amount of sliding frames 50. Two transport rollers 87 have a respective common individual electromotive drive 90. Each individual electro-motive drive 90 has a short circuit-proof electric motor 94. The electric motor drives the transport rollers 87 through a gear. As soon as a sliding frame comes to a standstill, the attached drive remains still in the connected condition, so that in this case, the need for a coupling is dispensed with.

Each transport roller 87 is connected to a chain wheel 91. The chain wheels of two neighboring transport rollers are connected together through a respective chain 92. Because of this, two neighboring transport rollers 87 are moved through a respective individual electro-motive drive.

FIG. 2 shows that the two rails 69 end at a ramp 93. The ramp 93 facilitates the in and out movement of the sliding frame 50.

The creel 21 is prepared for doffing the threads of a new batch as follows: All of the sliding frames 50 are moved out from the creel with the bobbin holder assemblies 40 fastened thereon. To this end, it is only necessary for the electro motors 94 which are connected in parallel to be switched for counterclockwise rotation. As soon as this happens, all of the sliding frames are moved out from the creel at the same time. Then, the web or fleece-shaped layer of dust and fly, which was collected during the preceding creel operation, is removed from the cover plates 50'. This can happen through a simple picking up of the dust, without unnecessarily creating a dust cloud. The floor and rails do not require cleaning. As preparatory measures, it is also necessary to move the two operation units 28 to their waiting positions. The waiting position is located on the projecting ends of the two horizontal beams 31 and 34. As soon as the two operation units 28 arrive in the waiting position, the yarn tensioner assemblies 58 can also be moved outwards with the handwheel 79 and the handle 80, respectively. This is required to draw the threads into the yarn tensioners. However, first of all, the bobbin holder assemblies 40 must be loaded with bobbins 23. This happens outside the creel. Thereupon the electric motors 94 are switched to a clockwise rotation and the sliding frames 50 are pushed one after the other into the creel path over the ramp 93. Further transport occurs automatically through the transport rollers 87. The first sliding frame moves through the creel path against a front projection and there it remains standing still. The next sliding frame follows the first sliding frame and so on, until all of the sliding frames are moved on the opposite projection into the creel. The electric motors 94 can now be disconnected. The hood-shaped sliding frames 50 of all of the bobbin holder assemblies 40 of the creel 21 are joined together and form a common accident-proof and dust preventive cover. At the start of the front end, the threads which come from the bobbins 23 are drawn into the yarn tensioner 26 and into the thread guide elements 27.

When all of the threads are drawn in and the operators have left the creel, the thread tensioner assemblies 58 are again driven closer to the bobbin holder assemblies 40 on both sides, and now the thread ends can, for example, be joined on the warp beam of a warp machine. The unwinding of the thread can now begin, after the two operation units 28 are in operation.

As soon as the bobbins 23 are emptied, a new loading follows without the batch change as previously described. In addition, it will be necessary, first of all, to move the yarn tensioner assemblies 58 aside, and to thereupon disconnect the threads, which are still connected to the individual bobbin. Then the bobbin holder assemblies can be moved from the creel. Besides the emptied running bobbins, bobbins with residual windings are also found in the bobbin holder assemblies. However, all old bobbin tubes are exchanged for new bobbins. After moving the reloaded bobbin holder assemblies in, the threads must be knotted. The knotting is not necessary when a batch change is in effect. For the batch change, it can be simpler to pull the threads of the old batch out from the creel and draw the new threads into the yarn tensioner.

The foregoing is a description corresponding to German application No. P 31 46 170.0, dated Nov. 21, 1981, the International priority of which is being claimed for the instant application, and which is hereby made part of this application. Any discrepancies between the foregoing specification and the aforementioned corresponding German application are to be resolved in favor of the latter.

We claim:

1. Creel, comprising a stationary supporting frame, at least one yarn tensioning holding element and at least one thread guiding element supported by said stationary supporting frame, bobbin holding assemblies disposed in vicinity of said stationary supporting frame, a plurality of bobbin holding elements carried on each of said bobbin holding assemblies, drive rollers connected to said bobbin holder assemblies for supporting said assemblies on a floor, separate hood-shaped sliding frames, each of said sliding frames being connected to a respective one of said assemblies, and separate upper cover plates each being disposed on a respective one of said sliding frames covering said drive rollers and part of the floor for preventing accidents and dust accumulation.

2. Creel according to claim 1, including rails disposed on the floor guiding said drive rollers, said rails being covered by said upper cover plates.

3. Creel according to claim 1, including movable operation units disposed on said stationary supporting frame for removing dust from the creel.

4. Creel according to claim 1, wherein said hood-shaped sliding frame for each of said bobbin holder assemblies are joined together to form a common accident preventive covering.

5. Creel according to claim 1, including stationary guiding rollers and transport rollers disposed on said stationary supporting frames, said sliding frames having side walls forming level rolling surfaces for at least one of said guiding and transport rollers.

* * * * *